US009252534B2

(12) United States Patent
Richards et al.

(10) Patent No.: US 9,252,534 B2
(45) Date of Patent: Feb. 2, 2016

(54) SWING MOUNT FOR TERMINAL BLOCKS

(71) Applicants: SCHNEIDER ELECTRIC USA, INC., Palatine, IL (US); Nathan Richards, Murfreesboro, TN (US)

(72) Inventors: Walter J. Richards, Murfreesboro, TN (US); German Romero Legorreta, Guadalupe (MX)

(73) Assignee: SCHNEIDER ELECTRIC USA, INC., Schaumburg, IL (US)

( * ) Notice: Subject to any disclaimer, the term of this patent is extended or adjusted under 35 U.S.C. 154(b) by 0 days.

(21) Appl. No.: 14/310,493

(22) Filed: Jun. 20, 2014

(65) Prior Publication Data

US 2015/0372418 A1 Dec. 24, 2015

(51) Int. Cl.
*H01R 13/60* (2006.01)
*H01R 13/629* (2006.01)

(52) U.S. Cl.
CPC ..... *H01R 13/629* (2013.01)

(58) Field of Classification Search
CPC ..... H01R 13/62933; H01R 13/629; H01R 13/14; H01R 13/518; H01R 23/025; H01R 2103/00; H01R 25/006; B60L 11/1818; Y02T 10/7005; Y02T 10/7088; H02G 3/14
USPC ..... 439/310, 131, 536
See application file for complete search history.

(56) References Cited

U.S. PATENT DOCUMENTS 2,185,562 A * 1/1940 Nielsen ..... 361/817
2,227,967 A * 1/1941 Favre ..... 361/641
2,594,369 A * 4/1952 Verkuil et al. ..... 340/307
2,822,451 A * 2/1958 Holmes ..... 200/300
3,003,085 A * 10/1961 Rund ..... 361/662
3,202,878 A * 8/1965 Rolph et al. ..... 439/51
3,482,143 A * 12/1969 Bugni et al. ..... 361/608
3,676,749 A * 7/1972 Wilson et al. ..... 361/609
3,801,765 A * 4/1974 Hodgson ..... 200/401
4,280,120 A * 7/1981 Trafford et al. ..... 340/303
4,664,456 A 5/1987 Blair et al.
4,768,967 A * 9/1988 Fritsch ..... 439/152
4,812,133 A 3/1989 Fleak et al.
4,864,690 A 9/1989 Chen
4,959,021 A * 9/1990 Byrne ..... 439/310
5,229,925 A * 7/1993 Spencer et al. ..... 361/814
5,328,388 A * 7/1994 Fust et al. ..... 439/544
5,393,242 A * 2/1995 VanDerStuyf ..... 439/364
5,486,664 A * 1/1996 Lamp et al. ..... 200/297
5,489,224 A * 2/1996 Schwarz ..... 439/752
5,504,991 A * 4/1996 Parmley, Sr. ..... 29/825
5,584,715 A * 12/1996 Ehrenfels ..... 439/222

(Continued)

*Primary Examiner* — Abdullah Riyami
*Assistant Examiner* — Vladimir Imas
(74) *Attorney, Agent, or Firm* — Locke Lord LLP

(57) ABSTRACT

A swing mount 110 for a terminal block includes a hinge 122 mounted on a wall 105 of an electrical enclosure 100, located near an opening 115 in the wall, for passing a movable plug connector 112 from inside the enclosure to connect to a terminal block 114 outside the enclosure. A lever 124 is carried by the hinge, for moving the moveable connector. A guide 130 for directing movement of the movable connector is mounted on the wall near the opening. A connector support 126 is mounted on the lever, supporting the movable connector, the support including a pin 138 that slideably engages a longitudinal slot 140 in the lever to move the support toward or away from the terminal block when the lever is actuated. The support includes a guide rail 134 that slides through slot 136 in the guide to align the movable connector with the opening.

10 Claims, 7 Drawing Sheets

(56) References Cited

U.S. PATENT DOCUMENTS

| | | | | | |
|---|---|---|---|---|---|
| 5,642,256 | A * | 6/1997 | Pugh et al. | 361/615 |
| 5,697,801 | A * | 12/1997 | Tsuji et al. | 439/310 |
| 5,737,189 | A * | 4/1998 | Kammersgard et al. | 361/726 |
| 5,813,880 | A * | 9/1998 | Kodama | 439/364 |
| 5,919,055 | A * | 7/1999 | Hattori | 439/310 |
| 5,927,766 | A * | 7/1999 | Rosen | 292/101 |
| 6,097,279 | A * | 8/2000 | Gow | 340/286.11 |
| 6,227,890 | B1 * | 5/2001 | Roper et al. | 439/218 |
| 6,418,027 | B1 * | 7/2002 | Suzuki et al. | 361/729 |
| 6,721,994 | B2 * | 4/2004 | Bowman et al. | 16/262 |
| 6,783,380 | B1 * | 8/2004 | Kamath et al. | 439/247 |
| 6,832,935 | B2 * | 12/2004 | Minowa et al. | 439/716 |
| 6,887,094 | B2 * | 5/2005 | Boeck et al. | 439/417 |
| 7,219,763 | B2 * | 5/2007 | Mizoguchi et al. | 181/158 |
| 7,303,420 | B2 * | 12/2007 | Huch et al. | 439/341 |
| 8,054,606 | B2 * | 11/2011 | Morris et al. | 361/115 |
| 8,840,427 | B2 * | 9/2014 | Ku et al. | 439/552 |
| 8,873,223 | B2 * | 10/2014 | Rahn et al. | 361/610 |
| 2011/0110049 | A1 * | 5/2011 | Lehtola et al. | 361/724 |
| 2015/0103472 | A1 * | 4/2015 | Oneufer et al. | 361/605 |

* cited by examiner

SWING MOUNT FOR TERMINAL BLOCKS

FIELD OF THE INVENTION

The invention is generally directed to connectors for a motor control unit.

BACKGROUND OF THE INVENTION

A motor control center (MCC) is an electrical cabinet dedicated to motor control. A motor control unit is generally a drawer-like container of electrical components, such as circuit breakers, motor starters, and pilot devices, which slides into a front section of an MCC and connects to a common power bus running vertically along the back side or back section of the MCC.

In order to provide access for pilot device signals and test signals, the motor control unit generally includes a feed-through connector mounted through a side wall of its enclosure. The control signals may include, for example, low voltage signals for pilot lights, push buttons, selector switches, or other control devices. The test signals may include, for example, low voltage signals for diagnostic maintenance, from internal test points.

SUMMARY OF THE INVENTION

In an example embodiment of the invention, a feed-through connection for an electrical enclosure, such as a motor control unit, may be connected or disconnected by an operator without first opening a wire-way along the outside of the electrical enclosure. A swing mount enables quickly connecting or disconnecting a moveable pluggable connector to a stationary terminal block located outside the electrical enclosure. The swing mount is carried on a hinge on an interior wall of the electrical enclosure. The hinge is located on one side of an opening in the wall. The opening is for passing the movable plug connector from inside the electrical enclosure to connect to a stationary terminal block located generally outside the electrical enclosure. A lever is pivotally mounted on the hinge, for actuating the swing mount to move the moveable plug connector toward or away from the stationary terminal block. An example guide may be mounted on the wall of the electrical enclosure and located near the opening in the wall. A connector support is mounted on the lever, the connector support supporting the movable plug connector. The connector support is preferably captured in a guide mounted to the interior wall. The connector support may include a pin that slideably engages a longitudinal slot in the lever to move the connector support toward or away from the stationary terminal block when the lever is actuated. The connector support may include a guide rail that slides through a slot in the guide to align the movable plug connector with the opening in the wall of the electrical cabinet. Other configurations for a guide and additional positioning elements between the terminal block and plug connector may be used. By actuating the lever, the moveable plug connector may be connected to or disconnected from the stationary terminal block without first opening a wire-way along the side of the electrical cabinet.

In an example embodiment, the lever may be a generally U-shaped frame having respective ends pivotally mounted on the hinge. An upper portion of the U-shaped lever may include the longitudinal slot and may be generally arcuate in shape, beginning near the hinge and extending toward the longitudinal slot. The U-shaped lever may include a lower portion of the lever with a lower longitudinal slot. The connector support may include a lower pin that slideably engages the lower longitudinal slot in the lower portion of the lever to move the connector support, in unison with the upper portion of the lever, toward or away from the stationary terminal block when the lever is actuated.

DETAILED DESCRIPTION OF THE EXAMPLE EMBODIMENTS

Figure 1:
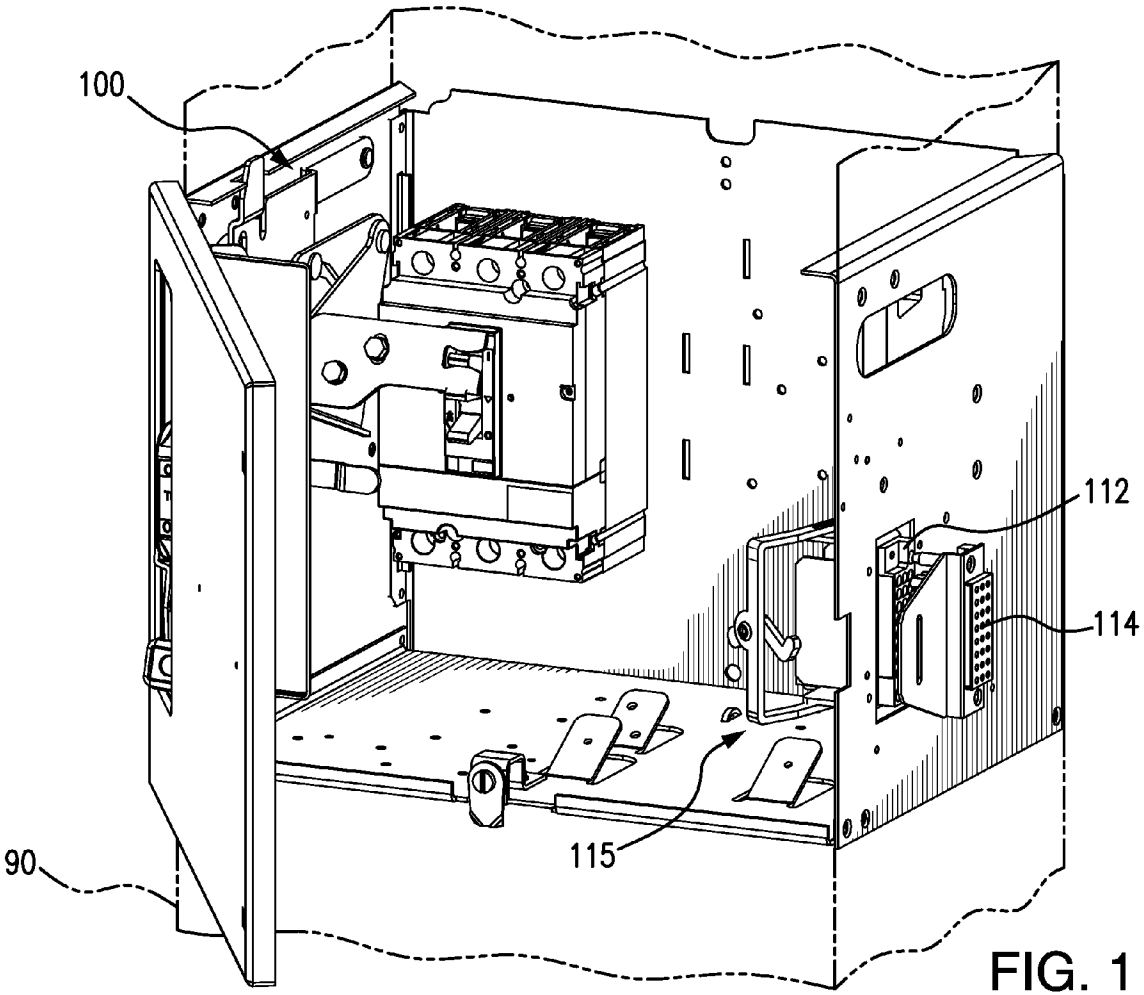
FIG. 1 is a front perspective view from the right side, of the MCC cabinet with the right side removed to show the stationary terminal block fastened to a structural member of the MCC cabinet, the figure further showing the motor control unit that slides into one of several available slots in the front of the MCC cabinet and connects to a common power bus running vertically along the back side or back section of the MCC cabinet. The motor control unit is shown with its access door open to show that it contains example electrical components, such as circuit breakers, motor starters, and pilot devices. The figure shows the swing mount in the disconnected position and the moveable plug connector disconnected from the stationary terminal block.

FIG. 1 is a front perspective view from the right side, of an MCC cabinet 90 with the right side removed to show a stationary terminal block 114 mounted on a structural member of the MCC cabinet 90. The figure further shows the motor control unit 100 that slides into one of several available slots in the front of the MCC cabinet 90 and connects to a common power bus running vertically along the back side or back section of the MCC cabinet 90. The motor control unit 100 enclosure is shown with its access door open to show that it contains example electrical components, such as circuit breakers, motor starters, and pilot devices. The figure shows a swing mount 110 in the enclosure, in a disconnected position 115 and a moveable plug connector 112 disconnected from the stationary terminal block 114. Electrical wiring to the moveable plug connector 112 is left out of the views in favor of clarity of illustration of the swing mount 110 but would be understood by the person having ordinary skill in the art to be present in a functional motor control unit 100. The stationary terminal block 114 conveys control signals, for example, for pilot lights, push buttons, selector switches, or other control devices operating at low, control voltages within the motor control unit 100. The stationary terminal block 114 may also convey test signals, for example, for diagnostic maintenance, from internal test points of the motor control unit 100.

Since space is limited inside the motor control unit 100, in previous motor control systems, an external wire-way along the side of the motor control unit 100 had to be opened to enable maintenance personnel to access the outside of the terminal block 114 for connection with a feed-through connector mounted through the wall of the motor control unit 100 enclosure. The feed-through connector was secured to the stationary terminal block 100 with screws or other fasteners. Later, when the motor control unit 100 was to be removed from the MCC cabinet 90 for service, the external wire-way along the side of the motor control unit 100 had to be reopened to gain access to the stationary terminal block 114 to disconnect the feed-through connector of the motor control unit 100.

Figure 2:
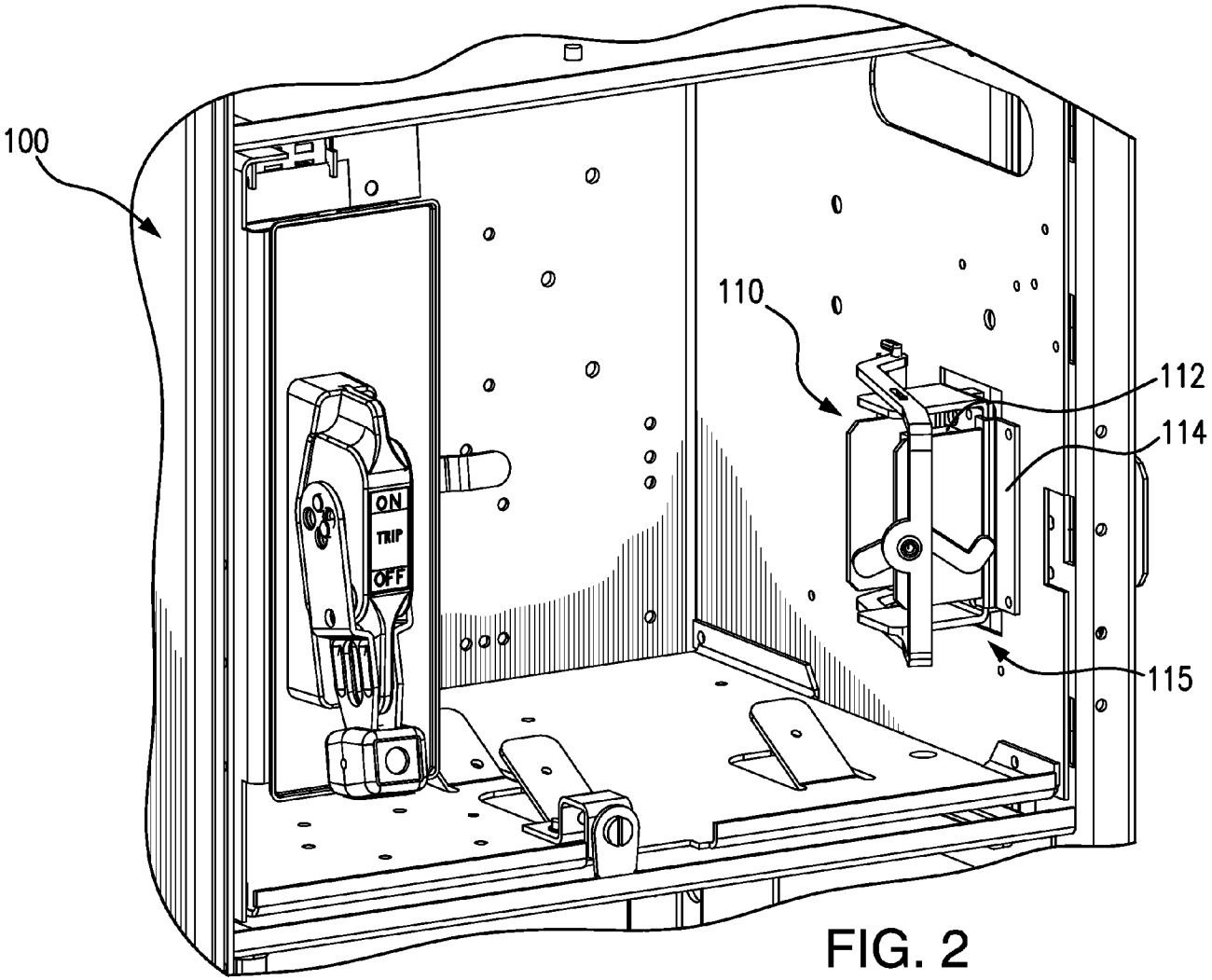
FIG. 2 is a front perspective view from the left side, of the motor control unit in the MCC cabinet, with the front door of the motor control unit removed to show one embodiment of the swing mount in the disconnected position with the moveable plug connector disconnected from the stationary terminal block.

In an example embodiment of the invention, a feed-through connection for an electrical enclosure, such as the motor control unit 100, may be established or disconnected by an operator without first opening an external wire-way along the outside of the enclosure of the motor control unit 100. The swing mount 110 shown in the figure, enables quickly connecting or disconnecting the moveable pluggable connector 112 and the stationary terminal block 114 located outside the electrical enclosure. FIG. 2 is a front perspective view from the left side, of the motor control unit 100 in the MCC cabinet 90, with the front door of the motor control unit 100 removed to show the swing mount 110 in the disconnected position 115 and the moveable plug connector 112 disconnected from the stationary terminal block 114.

Figure 3:
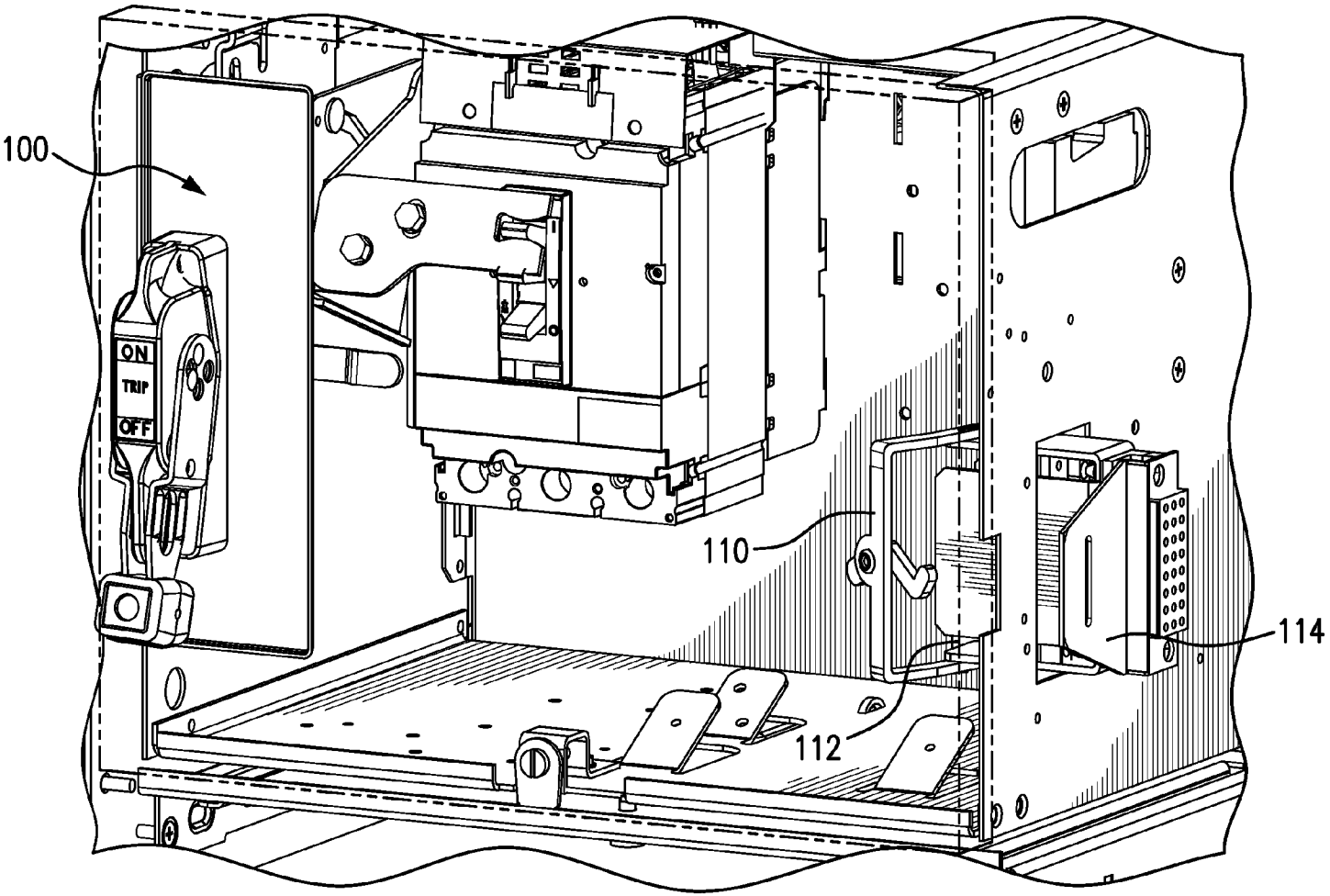
FIG. 3 is a front perspective view from the right side, of the motor control unit in the MCC cabinet with the right side of the MCC cabinet removed to show the stationary terminal block mounted to a structural member of the MCC cabinet, the figure showing the front door of the motor control unit removed to show the swing mount in the disconnected position and the moveable plug connector disconnected from the stationary terminal block.

FIG. 3 is a front perspective view from the right side, of the motor control unit 100 in the MCC cabinet 90 with the right side of the MCC cabinet 90 removed to show the stationary terminal block 114 mounted to a structural member of the MCC cabinet 90. The figure shows the front door of the motor control unit 100 removed to show the swing mount 110 in the disconnected position 115 and the moveable plug connector 112 disconnected from the stationary terminal block 114.

Figure 4:
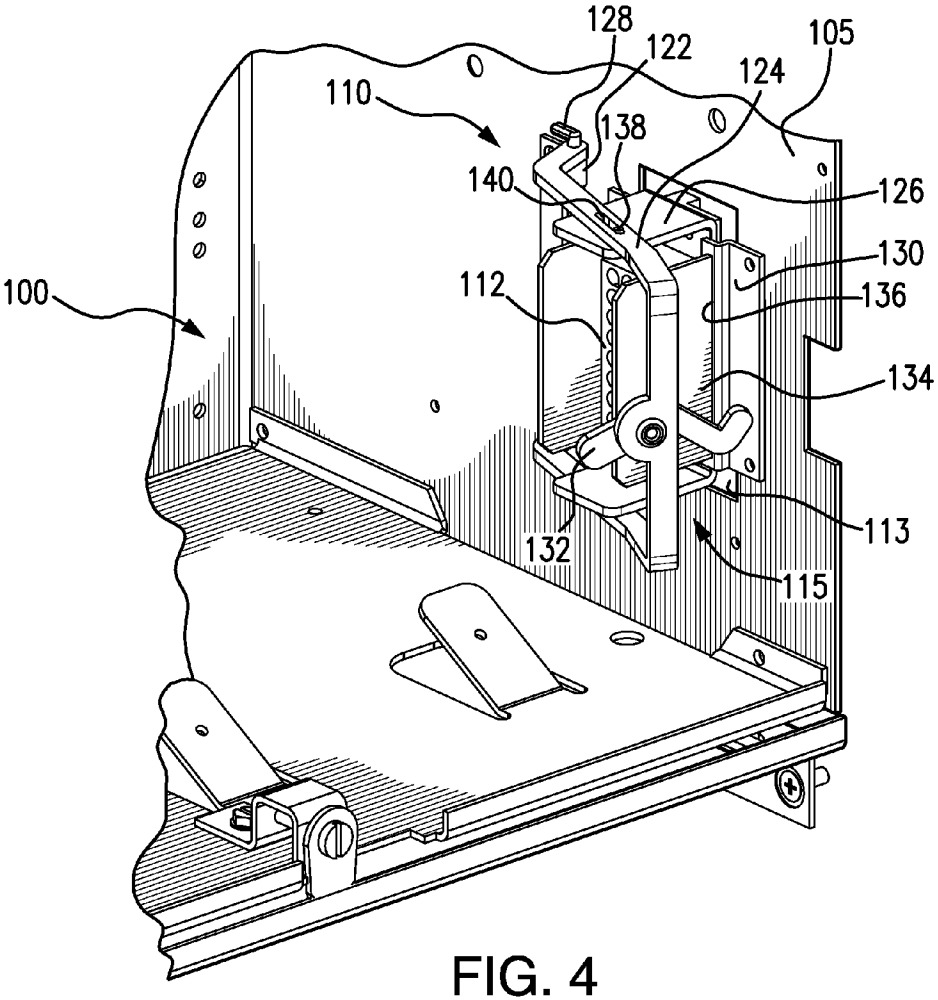
FIG. 4 is a front perspective view from the left side, of the motor control unit in the MCC cabinet, with the front door of the motor control unit removed to show a detailed view of another embodiment of the swing mount in the disconnected position.

FIG. 4 is a front perspective view from the left side, of the motor control unit 100 in the MCC cabinet 90, with the front door of the motor control unit 100 removed to show a detailed view of the swing mount 110 in the disconnected position 115 and the moveable plug connector 112 disconnected from the stationary terminal block 114.

A lever 124 is pivotally carried on a hinge 122 mounted on an interior surface of a wall 105 of the motor control unit 100 electrical enclosure. The hinge is located on an interior side of an opening 113 in the wall, the opening 113 for passing the movable plug connector 112 from inside the electrical enclosure of the motor control unit 100, to connect with the stationary terminal block 114 outside the electrical enclosure of the motor control unit 100. The lever 124 actuates the swing mount 110 to move the moveable plug connector 112 toward or away from the stationary terminal block 114.

A connector support 126 is mounted on the lever 124, the connector support 126 supporting the movable plug connector 112. The connector support 126 includes a pin 138 (shown in FIG. 7) that slides in a longitudinal slot 140 (shown in FIG. 7) in the lever 124 as the moveable plug connector 112 moves toward or away from the stationary terminal block 114. The longitudinal slot 140 acts as a cam to drive the pin 138 and thus the connector support 126 and moveable plug connector 112 toward or away from the stationary terminal block 114, as the lever 124 is actuated by the operator.

The 124 lever is a generally U-shaped frame pivotally mounted on the hinge 122, with an upper portion of the lever including the longitudinal slot 140. The lever 124 has one end mounted on the hinge 122 and may have a generally arcuate shape beginning near the hinge 122 and extending toward the longitudinal slot 140. The lever has a lower portion 124' including a lower longitudinal slot 140' (shown in FIG. 7). The connector support 126 includes a lower pin that slides in the lower longitudinal slot 140' as the moveable plug connector 112 moves toward or away from the stationary terminal block 114.

Figure 5:
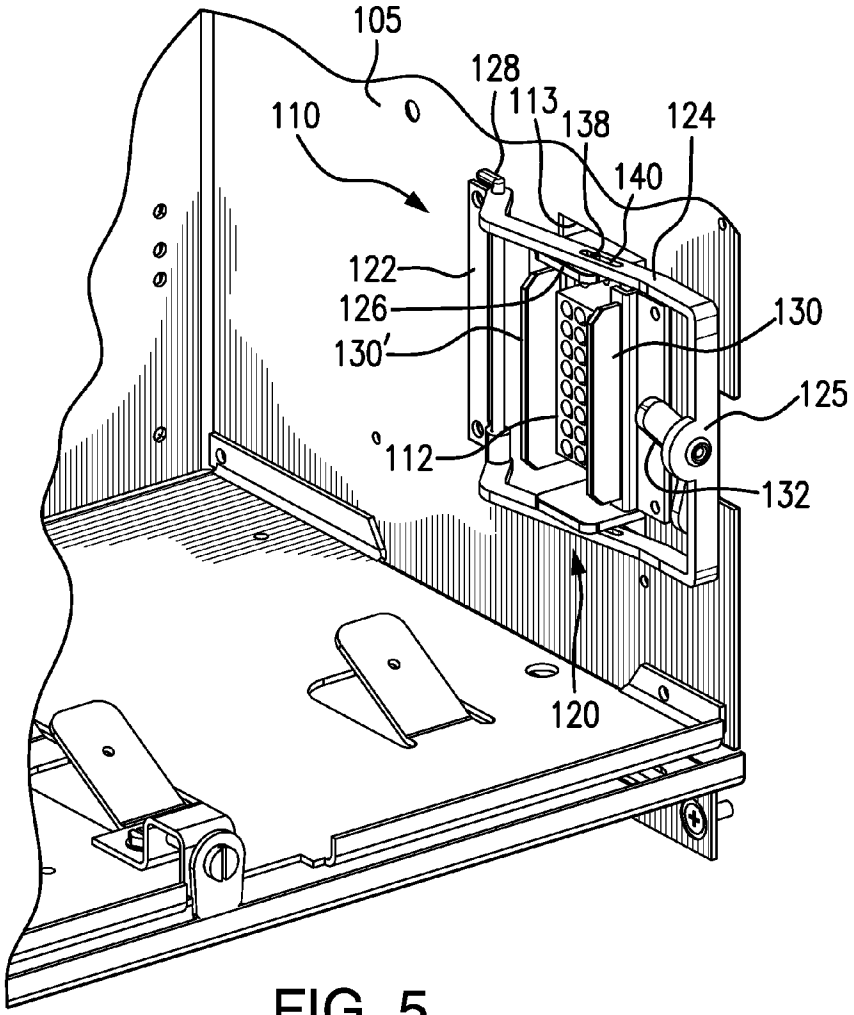
FIG. 5 is a front perspective view from the left side, of the motor control unit in the MCC cabinet, with the front door of the motor control unit removed to show a detailed view of the swing mount of FIG. 4 in the connected position, without showing the stationary terminal block.

A guide 130 is mounted on the wall 105 of the electrical enclosure of the motor control unit 100 and is located near the opening 113 in the wall 105. The connector support 126 includes a guide rail 134 that slides through a slot 136 in the guide 130 to align the movable plug connector 112 with the opening 113 in the wall 105 of the electrical enclosure of the motor control unit 100. A second guide 130' (shown in FIG. 7) is mounted on the wall 105 of the electrical enclosure and is located near the opening 113 opposite to the first guide 130. The connector support 126 includes a second guide rail 134' (shown in FIG. 7) that slides through a slot 136' (shown in FIG. 7) in the second guide 130' to align the movable plug connector 112 with the opening 113 in the wall 105 of the electrical enclosure. The connector support 126, guides 130 and 130', and guide rails 134, 134' constitute a captive mechanism for directing movement of the movable plug connector 112. A latch 132 is mounted on the lever 124, to secure the moveable plug connector 112 with the stationary terminal block 114 in the connected position 120. FIG. 5 shows a detailed view of the swing mount 110 in the connected position 120, without showing the stationary terminal block.

Figure 6B:
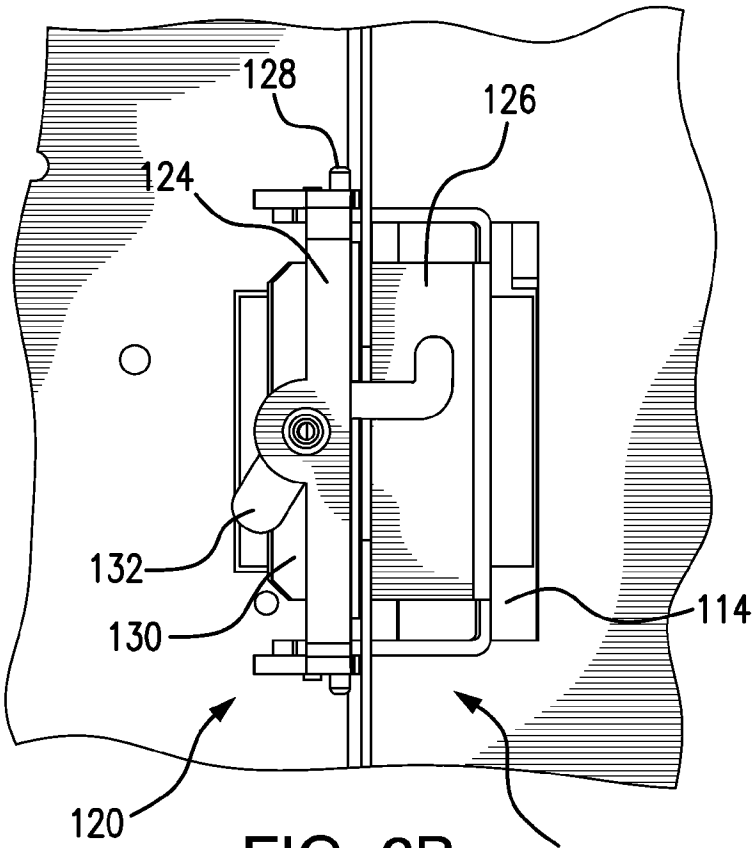
FIG. 6B is a front view of the swing mount in the connected position and the moveable plug connector connected to the stationary terminal block with the latch in the locked position.
Figure 6A:
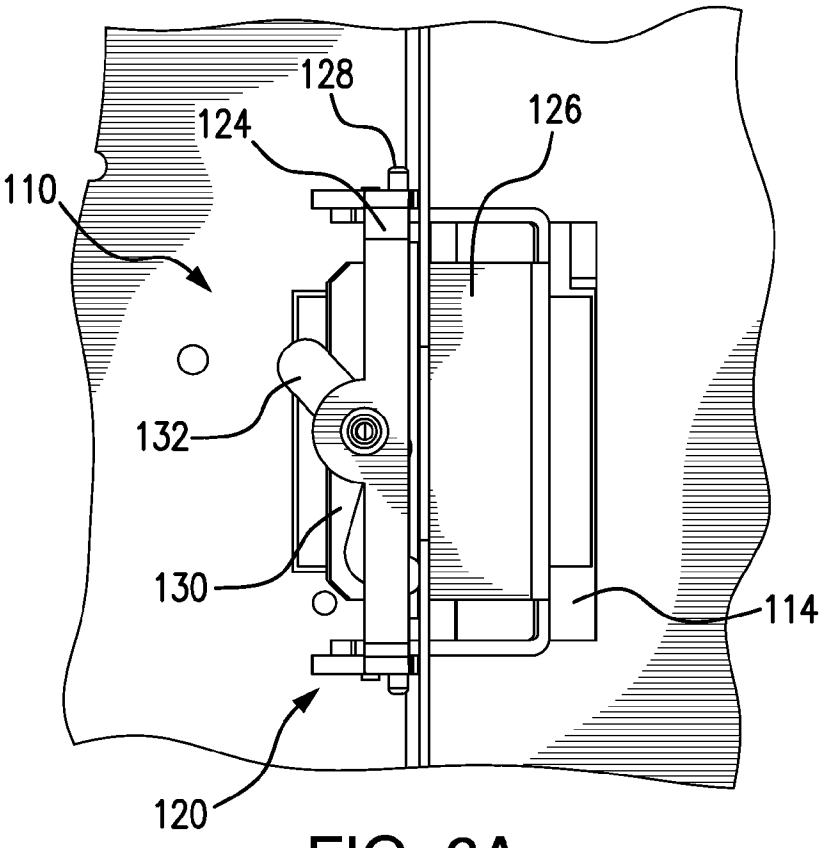
FIG. 6A is a front view of the swing mount in the connected position and the moveable plug connector connected to the stationary terminal block with the latch in the unlocked position.

FIG. 6A is a front view of the swing mount 110 in the connected position 120 and the moveable plug connector 112 connected to the stationary terminal block 114 with the latch 132 in the unlocked position. FIG. 6B shows the latch 132 in the locked position.

Figure 7:
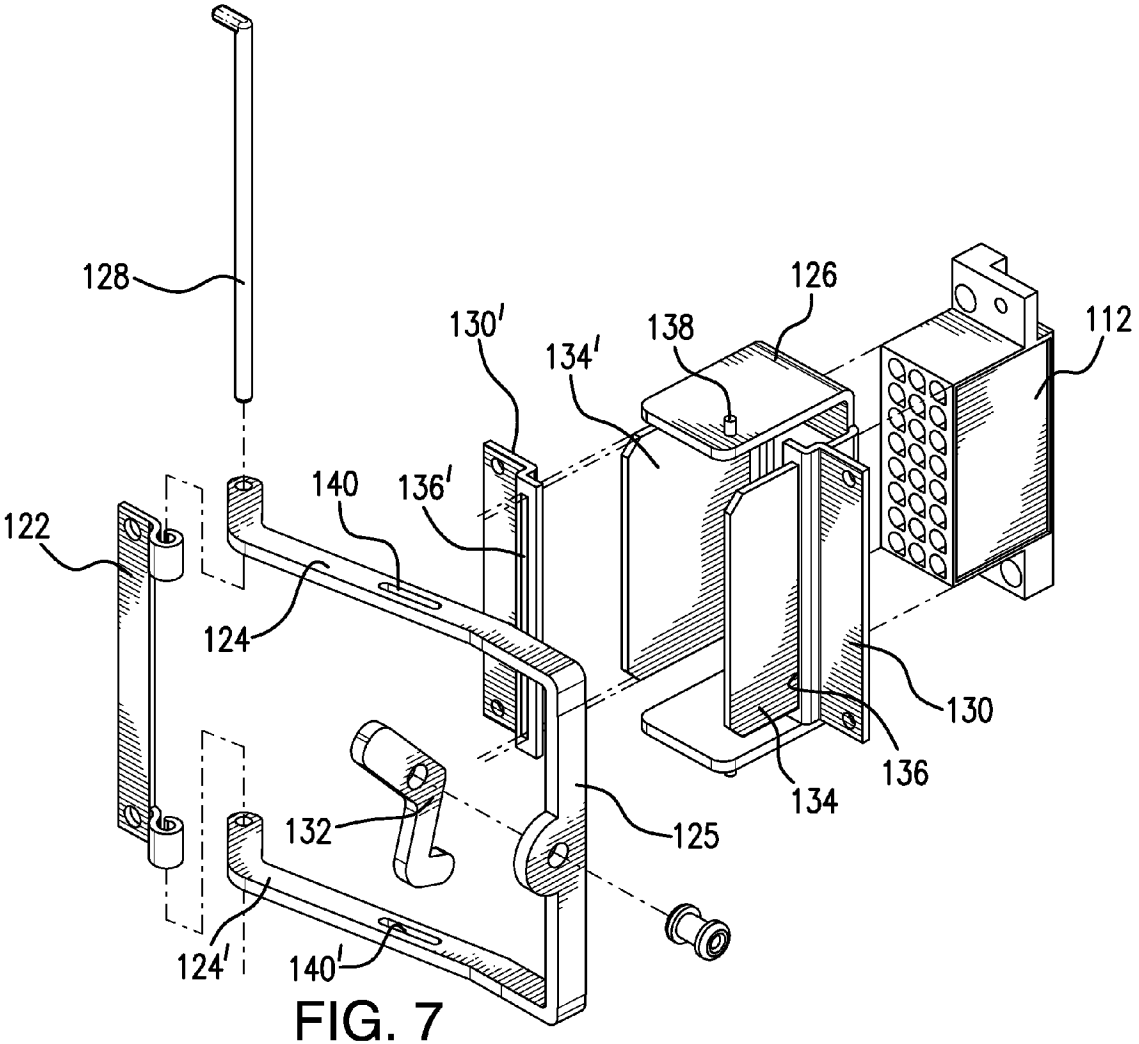
FIG. 7 is a front perspective, exploded view from the left side, of the swing mount, illustrating a lever pivotally carried on a hinge, to actuate the swing mount to move the moveable plug connector toward or away from the stationary terminal block. The figure shows a connector support mounted on the lever, supporting the movable plug connector. The connector support is shown including a pin that slides in a longitudinal slot in the lever as the moveable plug connector moves toward or away from the stationary terminal block.

FIG. 7 is a front perspective, exploded view from the left side, of the swing mount 110, illustrating the lever 124 pivotally mounted on the hinge 122 and hinge post 128. The lever 124 includes a handle 125 to actuate the swing mount 110 to move the moveable plug connector 112 toward or away from the stationary terminal block 114. The figure shows the connector support 126 mounted on the lever 124, supporting the movable plug connector 112. The connector support 126 is shown including a pin 138 that slides in the longitudinal slot 140 in the lever 124 as the moveable plug connector 112 moves toward or away from the stationary terminal block 114. The longitudinal slot 140 acts as a cam to drive the pin 138 and thus the connector support and moveable plug connector toward or away from the stationary terminal block 114, as the lever 124 is actuated by the operator.

The lever has a lower portion 124' including a lower longitudinal slot 140'. The connector support 126 includes a lower pin (not shown) that slides in the lower longitudinal slot 140' as the moveable plug connector 112 moves toward or away from the stationary terminal block 114, in a similar manner to that described for the action of the pin 138 in the longitudinal slot 140. The connector support 126 includes a second guide rail 134' that slides through a slot 136' in the second guide 130' to align the movable plug connector 112 with the opening 113 in the wall 105 of the electrical enclosure. Both of the guides 130 and 130' are mounted on the wall 105 of the electrical enclosure of the motor control unit 100, but in the perspective, exploded view of FIG. 7, the second guide 130' is shown in front of the second guide rail 134', to illustrate that the second guide rail 134' slides through the slot 136' of the second guide 130'.

In operation, the motor control unit 100 is inserted by the operator into an available slot of the MCC cabinet 90, so that the opening 113 in the wall 105 of the motor control unit 100 enclosure, is lined up with the externally accessible, stationary terminal block 114 mounted on the motor control center 90 structure outside the motor control unit 100. The swing mount 110 is then actuated to pass the movable plug connector 112 from inside the motor control unit 100 enclosure, to connect with the stationary terminal block 114 outside the motor control unit 100 enclosure. The movable plug connector 112 is connected through the opening 113 in the wall 105 of the motor control unit 100 enclosure, to the externally accessible terminal block 114.

In an example embodiment of the invention, a method for connecting a connector conveying signals from inside an electrical enclosure, to a terminal block mounted outside the electrical enclosure, comprises the steps of:

lining up an opening in a wall of an electrical enclosure, to an externally accessible terminal block mounted outside the electrical enclosure;

passing a movable plug connector from inside the electrical enclosure, through the opening in the wall of the electrical enclosure, toward the terminal block, the moveable plug connector conveying signals from inside the electrical enclosure; and connecting the moveable plug connector through the opening in the wall of the electrical enclosure, to the externally accessible terminal block mounted outside the electrical enclosure.

Although specific example embodiments of the invention have been disclosed, persons of skill in the art will appreciate that changes may be made to the details described for the specific example embodiments, without departing from the spirit and the scope of the invention.

What is claimed is:

1. A swing mount for a terminal block, comprising:

a lever pivotally carried on a hinge mounted on a wall of an electrical enclosure, the hinge located on an interior side of an opening in the wall, the opening for passing a movable plug connector from inside the electrical enclosure to connect with a stationary terminal block outside the electrical enclosure, the lever actuating the swing mount to move the moveable plug connector toward or away from the stationary terminal block; and a connector support mounted on the lever, the connector support supporting the movable plug connector, the connector support including a pin that slides in a longitudinal slot in the lever as the moveable plug connector moves toward or away from the stationary terminal block.

2. The swing mount for a terminal block of claim 1, further comprising:

the lever being a generally U-shaped frame pivotally mounted on the hinge, with an upper portion of the lever including the longitudinal slot.

3. The swing mount for a terminal block of claim 2, further comprising:

the lever having a lower portion including a lower longitudinal slot; and the connector support including a lower pin that slides in the lower longitudinal slot as the moveable plug connector moves toward or away from the stationary terminal block.

4. The swing mount for a terminal block of claim 1, further comprising:

a guide mounted on the wall of the electrical enclosure and located near the opening in the wall; and the connector support including a guide rail that slides through a slot in the guide to align the movable plug connector with the opening in the wall of the electrical enclosure.

5. The swing mount for a terminal block of claim 4, further comprising:

a second guide mounted on the wall of the electrical enclosure and located near the opening opposite to the first said guide; and the connector support including a second guide rail that slides through a slot in the second guide to align the movable plug connector with the opening in the wall of the electrical enclosure.

6. The swing mount for a terminal block of claim 1, further comprising:

a latch mounted on the lever, to secure the moveable plug connector with the stationary terminal block in a connected position.

7. The swing mount for a terminal block of claim 1, further comprising:

the electrical enclosure being a motor control unit with the moveable plug connector located inside the motor control unit and the stationary terminal block mounted to a motor control center structure outside of the motor control unit.

8. The swing mount for a terminal block of claim 1, further comprising:

the movable plug connector, when connected to the stationary terminal block, providing feed-through terminals for test points or pilot devices or both.

9. The swing mount for a terminal block of claim 1, further comprising:

the lever having one end mounted on the hinge and having generally arcuate shape beginning near the hinge and extending toward the longitudinal slot.

10. A motor control unit, comprising:

a swing mount for a terminal block, mounted on an interior side of a wall of the motor control unit;

the swing mount including a lever pivotally carried on a hinge located on the interior side of an opening in the wall, the opening for passing a movable plug connector from inside the motor control unit, to connect with a stationary terminal block outside the motor control unit, the lever actuating the swing mount to move the moveable plug connector toward or away from the stationary terminal block; and the swing mount further including a connector support mounted on the lever, the connector support supporting the movable plug connector, the connector support including a pin that slides in a longitudinal slot in the lever as the moveable plug connector moves toward or away from the stationary terminal block.

* * * * *